US010889458B2

(12) United States Patent
Kurosaki

(10) Patent No.: US 10,889,458 B2
(45) Date of Patent: Jan. 12, 2021

(54) METHOD FOR MANUFACTURING CORELESS PAPER ROLL

(71) Applicant: CORELEX SHIN-EI CO., LTD., Fuji (JP)

(72) Inventor: Satoshi Kurosaki, Fuji (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 15 days.

(21) Appl. No.: 16/461,183

(22) PCT Filed: Nov. 29, 2017

(86) PCT No.: PCT/JP2017/042805

§ 371 (c)(1),
(2) Date: May 15, 2019

(87) PCT Pub. No.: WO2018/173368

PCT Pub. Date: Sep. 27, 2018

(65) Prior Publication Data

US 2020/0062530 A1 Feb. 27, 2020

(30) Foreign Application Priority Data

Mar. 24, 2017 (JP) ..... 2017-058403

(51) Int. Cl.
*B65H 35/00* (2006.01)
*B65H 18/10* (2006.01)

(52) U.S. Cl.
CPC ..... *B65H 35/0013* (2013.01); *B65H 18/10* (2013.01); *B65H 35/008* (2013.01); *Y10T 156/1052* (2015.01)

(58) Field of Classification Search
CPC .. B65H 18/10; B65H 35/0013; B65H 35/008; B65H 19/29; B65H 2301/41484; B65H 2301/414433; B65H 2301/414436
See application file for complete search history.

(56) References Cited

U.S. PATENT DOCUMENTS 2,610,934 A * 9/1952 Steele ..... B31D 3/0246 156/197
5,387,284 A * 2/1995 Moody ..... B65H 18/20 118/220

FOREIGN PATENT DOCUMENTS

JP 06-127758 A 5/1994
JP 2001-261203 A 9/2001
(Continued)

OTHER PUBLICATIONS

International Search Report for PCT/JP2017/042805 dated Jan. 16, 2018 (PCT/ISA/210).

*Primary Examiner* — Mark A Osele
*Assistant Examiner* — Christopher C Caillouet
(74) *Attorney, Agent, or Firm* — Sughrue Mion, PLLC

(57) ABSTRACT

A coreless paper roll manufacturing method includes: unrolling a wide tissue web from a parent roll; spraying adhesive on the wide tissue web; winding the wide tissue web on a winding mandrel to form a log roll; and cutting the log roll to form a plurality of paper rolls. The spraying includes depositing a first adhesive, having a bonding strength capable of solidifying the wide tissue web wound on the winding mandrel and separating a sheet of tissue from the solidified wide tissue web, on parts of the wide tissue web from which the wide tissue web starts to be wound, the parts including both ends of the wide tissue web in the width direction and positions at which the log roll is cut, and depositing a second adhesive having a lower bonding strength than the first adhesive on parts between the parts where the first adhesive is deposited.

1 Claim, 2 Drawing Sheets

(56) References Cited

FOREIGN PATENT DOCUMENTS

| | | | |
|---|---|---|---|
| JP | 2012-050475 | A | 3/2012 |
| JP | 2016-059760 | A | 4/2016 |
| JP | 2016-131761 | A | 7/2016 |

* cited by examiner

METHOD FOR MANUFACTURING CORELESS PAPER ROLL

This application is a National Stage of International Application No. PCT/JP2017/042805 filed Nov. 29, 2017, claiming priority based on Japanese Patent Application No. 2017-058403 filed Mar. 24, 2017.

TECHNICAL FIELD

The present invention relates to a method for manufacturing a coreless paper roll with which a coreless paper roll can be used up to the trailing end of the roll.

BACKGROUND ART

Typical paper rolls such as toilet paper rolls have tubular cores made of cardboard or the like and are formed in a roll by winding a web of paper, which is made of a tissue material, on the cores. In addition, coreless toilet paper rolls, which do not have such cardboard cores and are formed in rolls by winding a tissue material alone, are also produced.

In paper rolls having no cores made of cardboard or the like, particularly when an external force is applied in the axial direction of the rolls, the roll shape is pressed flat, and the center holes or the like are likely to be deformed. Hence, when a coreless paper roll is produced, adhesive is applied to a portion of a tissue material from which the tissue material starts to be wound, and then the tissue material is wound, thus stiffening the portion of the tissue material constituting the core of the paper roll in a tubular shape (for example, see PTL 1).

Furthermore, when toilet paper rolls and the like are produced, a wide toilet paper web is unrolled from a parent roll and is wound on a winding mandrel to produce a log roll. The log roll is then cut into round slices at a plurality of predetermined positions to produce a plurality of toilet paper rolls having a paper width equal to the paper width of products (for example, see PTL 2).

CITATION LIST

Patent Literature

[PTL 1] Japanese Unexamined Patent Application Publication No. 2016-131761

[PTL 2] Japanese Unexamined Patent Application Publication No. 2016-59760

SUMMARY OF INVENTION

Technical Problem

As described above, in a conventional coreless paper roll, adhesive or the like is uniformly applied to a portion from which the roll starts to be wound to stiffen a core portion constituting the center hole. Hence, when the paper roll is almost used up, it is difficult to separate a sheet of tissue from the stiffened portion to use the sheet. Furthermore, because the stiffened portion cannot be separated into sheets of tissue, the stiffened portion has to be discarded, leading to a problem in that there still is a portion to be discarded even if products made only of a tissue material are provided.

The present invention has been made in view of the above-described problem, and an object thereof is to provide a method for manufacturing a coreless paper roll that can be used up without leaving a portion to be discarded.

Solution to Problem

A method for manufacturing a coreless paper roll of the present invention includes: a first step in which a wide tissue web is unrolled from a parent roll; a second step in which adhesive is sprayed on the wide tissue web; a third step in which the wide tissue web is wound on a winding mandrel to form a log roll; and a fourth step in which the log roll is cut into round slices to form a plurality of paper rolls. The second step includes a fifth step in which a first adhesive, which has a bonding strength capable of solidifying the wide tissue web wound on the winding mandrel and capable of separating a sheet of tissue from the solidified wide tissue web, is deposited on a portion of the wide tissue web from which the wide tissue web starts to be wound on the winding mandrel, the portion including both ends in the width direction of the wide tissue web and positions at which the log roll is cut in the fourth step, and a sixth step in which a second adhesive having a lower bonding strength than the first adhesive is deposited on portions between the positions where the first adhesive is deposited.

In the fifth step, the first adhesive is deposited on portions to be in contact with support members of a holder for holding a paper roll cut in the fourth step when the support members are inserted into the center hole of the paper roll.

Advantageous Effects of Invention

According to the present invention, it is possible to use up a paper roll without leaving a portion corresponding to the core unused, and it is possible to easily unroll the paper roll to the trailing end while preventing a sheet of tissue from being torn when the sheet of tissue is unrolled from the roll shape.

DESCRIPTION OF EMBODIMENTS

An embodiment of the present invention will be described below.

Embodiment

Figure 1A:
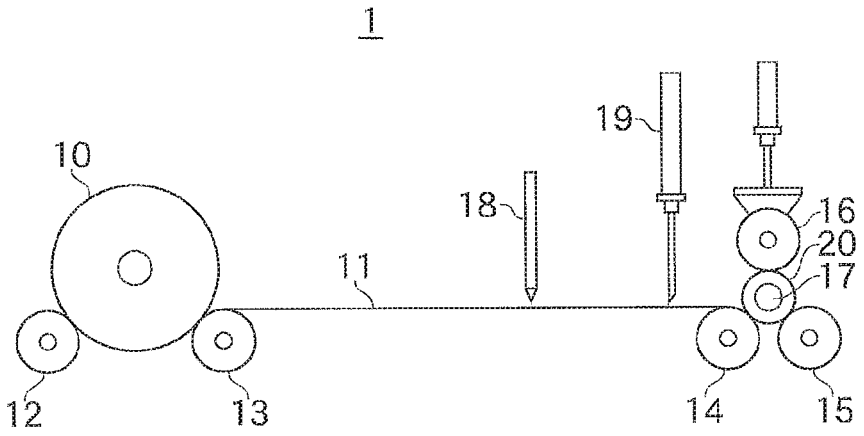
FIGS. 1A and 1B are schematic diagrams showing the configuration of a production apparatus that employs a method for manufacturing a coreless paper roll of the present invention.
Figure 1B:
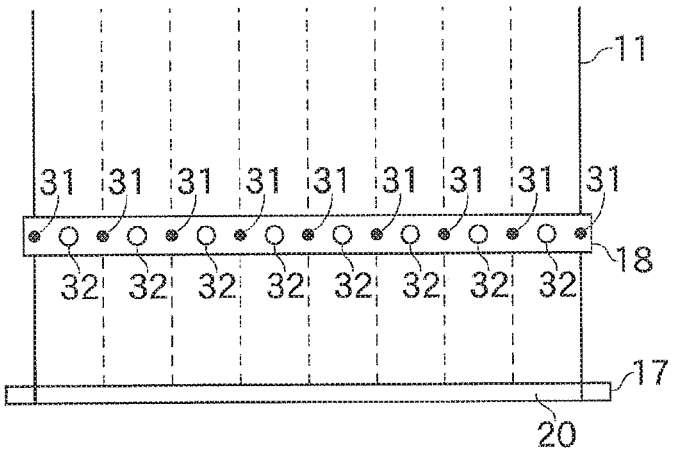

FIGS. 1A and 1B are schematic diagrams showing the configuration of a production apparatus 1 that employs a method for manufacturing a coreless paper roll of the present invention. FIG. 1A shows the arrangement and configurations of the respective components of the production apparatus 1, as viewed from the side. Furthermore, FIG. 1B shows, in a simplified manner, a portion of the production apparatus 1 in which the respective adhesives are applied to a wide paper web 11 (wide tissue web), and shows the arrangement of the respective components when a surface of the wide paper web 11 transported from a parent roll 10 to a winding mandrel 17 in the production apparatus 1 is viewed from above. In FIG. 1B, the illustrations of the cutter 19 and the like shown in FIG. 1A are omitted.

In the production apparatus 1, the parent roll 10 is disposed at a predetermined position, and the production apparatus 1 includes feeding rollers 12 and 13, which unroll the wide paper web 11 from the parent roll 10, so as to be in contact with the outer circumference of the parent roll 10. The production apparatus 1 also includes friction rollers 14 and 15 and a rider roller 16 around the winding mandrel 17 and is arranged and configured such that the wide paper web 11 is wound on the winding mandrel 17.

The production apparatus 1 also includes an adhesive dispenser 18 and a cutter 19 between the parent roll 10 and the winding mandrel 17. In the production apparatus 1 shown in FIG. 1A, the adhesive dispenser 18 and the cutter 19 are disposed at positions immediately before the position where the wide paper web 11 fed from the feeding roller 13 is wound on the winding mandrel 17 (near the winding mandrel 17).

As shown in FIG. 1B, the adhesive dispenser 18 is disposed above the surface of the wide paper web 11 unrolled from the parent roll 10 and is arranged so as to extend linearly between both ends in the width direction of the wide paper web 11.

Furthermore, a plurality of sprayers 31 and sprayers 32 are alternately arranged in the adhesive dispenser 18, and the adhesive dispenser 18 is configured to spray different adhesives onto predetermined positions (predetermined area) on the surface of the wide paper web 11.

More specifically, the sprayers 31 and the sprayers 32 are alternately arranged side-by-side such that the sprayers 31 are located at both ends in the width direction of the wide paper roll 11.

As will be described below, the sprayers 31 are configured to spray a first adhesive, which has a bonding strength capable of solidifying the wide paper web 11 wound on the winding mandrel 17 and capable of easily separating a sheet of tissue from the solidified wide paper web 11 afterwards.

The sprayers 32 are configured to spray a second adhesive, which has a lower bonding strength than the first adhesive and, when solidified, is inferior in stiffness or the like than the portion solidified by the first adhesive, thus allowing a sheet of tissue to be easily separated.

Note that, it is also possible to configure such that the production apparatus 1 includes control means or the like, and the control means or the like controls the respective components of the production apparatus 1 to perform an operation described herein.

Next, the operation will be described.

In the production apparatus 1, the parent roll 10 is rotated by, for example, rotationally driving the feeding rollers 12 and 13 to unroll the wide paper web 11 from the parent roll 10 at a predetermined rate, and the wide paper web 11 is moved toward the winding mandrel 17.

The wide paper web 11 reaching the vicinity of the winding mandrel 17 is nipped between the winding mandrel 17 and the friction roller 14 and between the winding mandrel 17 and the friction roller 15 and is wound around the shaft of the winding mandrel 17.

Furthermore, while the wide paper web 11 successively fed from the parent roll 10 is wound on the above-described winding mandrel 17, the rider roller 16 applies an appropriate pressure to the outer circumferential portion of the wound wide paper web 11 to prevent creases or the like and to make the wound wide paper web 11 form a perfect circle shape around the winding mandrel 17 that serves as the core.

When the radius of the portion wound in a perfect circle shape has reached a predetermined dimension or when a predetermined length of the wide paper web 11 has been wound by continuously winding the wide paper web 11, feeding of the wide paper web 11 from the parent roll 10 is stopped, and the cutter 19 is actuated to cut the wide paper web 11 drawn in between the friction roller 14 and the winding mandrel 17, thus forming a log roll 20.

Figure 2:
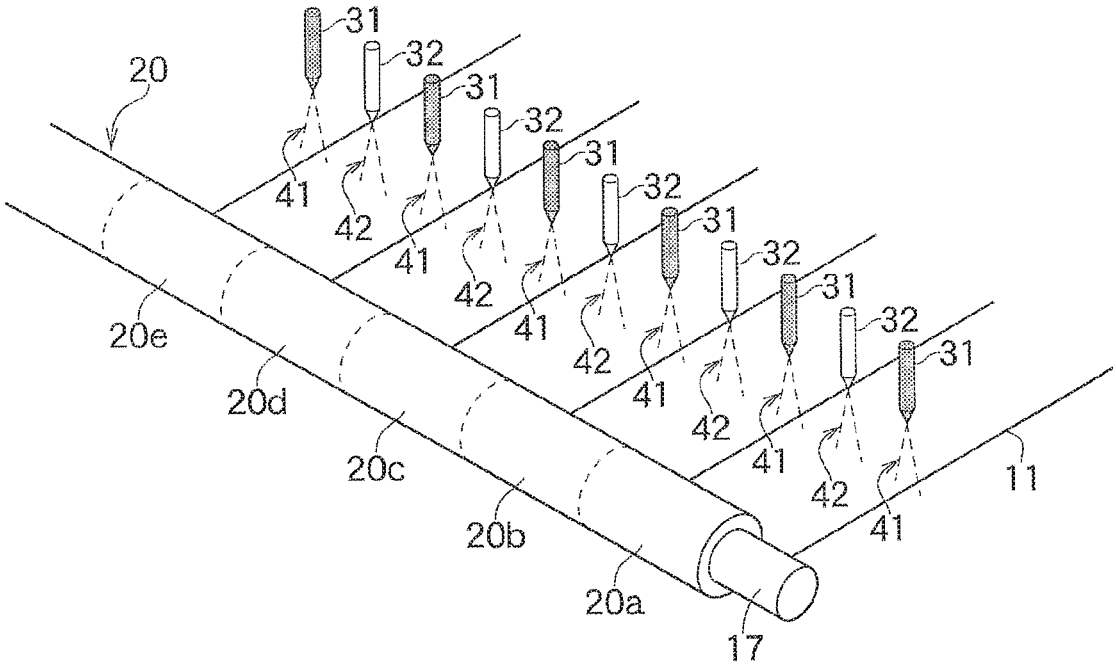
FIG. 2 is a diagram showing the operation of the production apparatus in FIGS. 1A and 1B.

FIG. 2 is a diagram showing the operation of the production apparatus 1 in FIGS. 1A and 1B. FIG. 2 is a perspective view of a portion where the wide paper web 11 is wound on the winding mandrel 17, and illustrations of the friction rollers 14 and 15, the rider roller 16, the cutter 19, and the like are omitted. Furthermore, the sprayers 31 and 32 provided in the adhesive dispenser 18 are shown, and the illustration of the detailed configuration of the adhesive dispenser 18 is omitted. Note that, in FIG. 2, the portions indicated by dashed lines show the positions at which the finished log roll 20 is cut into round slices after winding of the wide paper web 11 is completed.

As described above, the adhesive dispenser 18 includes a plurality of sprayers 31 and sprayers 32, which are linearly arranged in the width direction of the wide paper web 11.

The sprayers 31 are arranged so as to spray the first adhesive 41 to both ends, in the width direction, of the wide paper web 11 immediately before being wound on the winding mandrel 17 and to the positions at which the log roll 20 is cut into round slices. The sprayers 32 provided in the adhesive dispenser 18 are one fewer than the sprayers 31 and are arranged so as to spray the second adhesive 42 to the portions between the positions (on the surface of the wide paper web 11) to which the sprayers 31 spray the first adhesive 41.

The adhesive dispenser 18 configured as above sprays the first adhesive 41 and the second adhesive 42 via the sprayers 31 and the sprayers 32, respectively, onto the moving wide paper web 11 at, for example, the same time, thereby linearly depositing the respective adhesives in the width direction of the wide paper web 11.

More specifically, the first adhesive 41 sprayed from the sprayers 31 is deposited on predetermined areas extending from the cutting positions so as to extend over the cutting positions indicated by the dashed lines. The second adhesive 42 sprayed from the sprayers 32 is deposited on areas between the areas on which the first adhesive 41 is deposited in the width direction of the wide paper web 11, thus bonding the central portions, in the width direction, of toilet paper rolls (paper rolls) formed by cutting the log roll 20. That is, two types of adhesive are deposited on predetermined areas such that the same core portions are formed in the cut toilet paper rolls.

The first adhesive 41 and the second adhesive 42 are deposited on the portion (the leading end and the like) of the wide paper web 11 from which it starts to be wound, immediately before the wide paper web 11 is wound on the winding mandrel 17. By winding, on the winding mandrel 17, the portion from which the wide paper web 11 starts to be wound and then the subsequent wide paper web 11, on which the respective adhesive width is not deposited, the log roll 20 is formed.

Note that the respective adhesives are sprayed on, for example, an area of the wide paper web 11 to be wound a plurality of turns on the winding mandrel 17. By depositing the first adhesive 41 and the second adhesive 42 in a separated manner on an area of the wide paper web 11 having a length with which an appropriate winding thickness is achieved, core portions having both ends that are more rigidly solidified than the central portions are formed.

Once a predetermined length of wide paper web 11 has been wound on the winding mandrel 17, as described above, the wide paper web 11 is cut in the width direction with the cutter 19, forming the log roll 20. At this time, it is also possible to deposit an appropriate amount of the second adhesive 42 on the portion cut by the cutter 19, that is, the trailing end portion of the web wound on the log roll 20, to prevent the wide paper web 11 wound on the extreme outer circumference from being easily unrolled from the roll shape.

Thereafter, the log roll 20 from which the winding mandrel 17 is removed is moved to, for example, a portion of a production apparatus (not shown) or the like or is disposed in another production apparatus and is cut into round slices at the dashed-line positions shown in FIG. 2. Thus, toilet paper rolls (paper rolls) 20*a*, 20*b*, 20*c*, 20*d*, 20*e*, etc. having a predetermined width are formed. Note that the number of toilet paper rolls cut from the log roll 20 is not limited to the number shown in FIG. 2.

Figure 3:
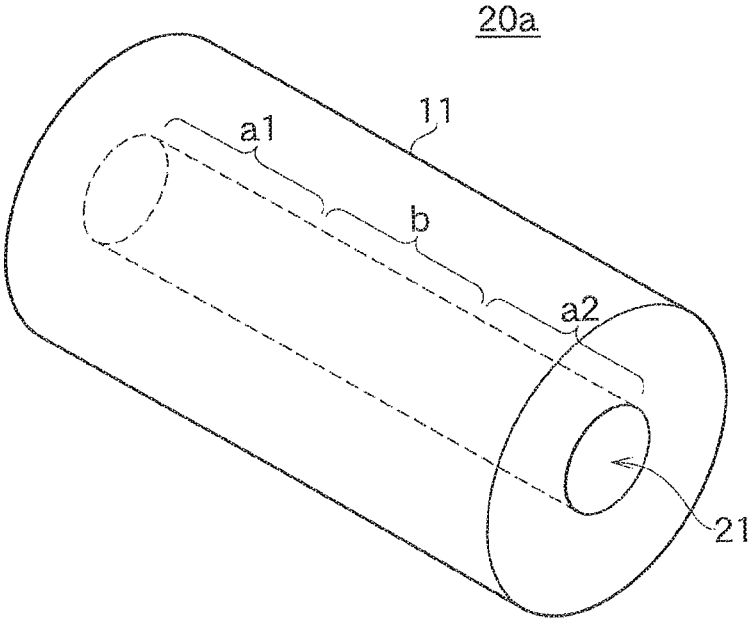
FIG. 3 is a general view of a toilet paper roll cut out from a log roll in FIG. 2.

FIG. 3 is a general view of the toilet paper roll 20*a* cut from the log roll 20 shown in FIG. 2. Because the respective toilet paper rolls cut from the log roll 20 have the same configuration the toilet paper roll 20*a* will be described as an example herein.

The toilet paper roll 20*a* has a center hole 21 formed at a position where the winding mandrel 17 was before it was removed from the log roll 20. The center hole 21 is a circular through-hole extending along the core of the roll shape and has a uniform inside diameter.

The first adhesive 41 is deposited on the inner wall portions a1 and a2 of the center hole 21 shown in FIG. 3, and the second adhesive 42 is deposited on the inner wall portion b. That is, the toilet paper rolls 20*a* to 20*e* cut from the log roll 20 each have the inner wall portions a1 and a2 of the center hole 21 solidified by the first adhesive 41 and the inner wall portion b solidified by the adhesive 42. Thus, the inner walls of the center holes 21 are rigid enough not to be easily deformed.

Furthermore, as described above, because the first adhesive 41 is deposited on the predetermined areas extending over the cutting portions when the log roll 20 is wound up, the openings of the center hole 21 located on both sides of the toilet paper roll 20*a* or the vicinity thereof are more strongly solidified than the other portion. Thus, deformation of particularly the sides of the toilet paper roll 20*a* is mainly prevented.

It is desirable that the depth of the inner wall portions a1 and a2 of the center hole 21 be set according to, for example, the length of support members provided on a so-called one-touch holder for holding the toilet paper roll 20*a*. The support members are configured to be inserted from both ends of the center hole 21 when the toilet paper roll 20*a* is held on the one-touch holder. Hence, the inner wall portions a1 and a2 having a depth substantially equal to the length of the support members are provided, and the center hole 21 is configured such that the support members come into contact with the portions that are more rigidly solidified than the other portion. With this configuration, the toilet paper roll 20*a* held by the one-touch holder easily rotates, allowing a sheet of tissue to be easily unrolled from the roll shape. In other words, it is desirable that the areas on which the first adhesive 41 is deposited be set according to the length of the support members.

By increasing the rigidity of the portions to be in contact with the support members of the one-touch holder as described above, it is possible to prevent the toilet paper roll 20*a* held by the one-touch holder from being easily deformed.

Furthermore, because the inner wall portions a1 and a2 are more rigidly solidified or bonded than the inner wall portion b, that is, because the bonding strength at the central portion in the width direction of the tissue web is lower than the bonding strength at the both ends, it is possible to prevent a sheet of tissue separated from the solidified portion from being torn when the central portion of the sheet of tissue is held by hand and is unrolled, and thus to use up the toilet paper roll 20*a* to the end, without leaving the portion corresponding to the core unused.

REFERENCE SIGNS LIST

1 production apparatus
10 parent roll
11 wide paper web
12, 13 feeding roller
14, 15 friction roller
16 rider roller
17 winding mandrel
18 adhesive dispenser
19 cutter
20 log roll
20*a* to 20*e* toilet paper roll
21 center hole
31, 32 sprayer
41 first adhesive
42 second adhesive

The invention claimed is:

1. A method for manufacturing a coreless paper roll, the method comprising:

a first step in which a tissue web is unrolled from a parent roll;

a second step in which adhesive is sprayed on the tissue web;

a third step in which the tissue web is wound on a winding mandrel to form a log roll; and a fourth step in which the log roll is cut into round slices to form a plurality of paper rolls, wherein the second step includes a fifth step in which a first adhesive, which has a bonding strength capable of solidifying the tissue web wound on the winding mandrel and capable of separating a sheet of tissue from the solidified tissue web, is deposited on a portion of the tissue web from which the tissue web starts to be wound on the winding mandrel, the portion including both ends in the width direction of the tissue web and positions at which the log roll is cut in the fourth step, and a sixth step in which a second adhesive having a lower bonding strength than the first adhesive is deposited on portions between the positions where the first adhesive is deposited.

* * * * *